US011221196B2

(12) United States Patent
Babu et al.

(10) Patent No.: US 11,221,196 B2
(45) Date of Patent: Jan. 11, 2022

(54) VEHICLE AND METHOD FOR DETECTING AND NEUTRALIZING AN INCENDIARY OBJECT

(71) Applicant: Director General, Defence Research & Development Organisation (DRDO), New Delhi (IN)

(72) Inventors: Natesan Babu, Chennai (IN); Alexander Rajasekaran, Chennai (IN); Swarna Ramesh, Chennai (IN); Lakshmi Prathibha Perumal Thirunavukkarasu, Chennai (IN)

(73) Assignee: DIRECTOR GENERAL, DEFENCE RESEARCH & DEVELOPMENT ORGANISATION (DRDO), New Delhi (IN)

( * ) Notice: Subject to any disclaimer, the term of this patent is extended or adjusted under 35 U.S.C. 154(b) by 189 days.

(21) Appl. No.: 15/561,479

(22) PCT Filed: Mar. 29, 2016

(86) PCT No.: PCT/IB2016/051766
§ 371 (c)(1),
(2) Date: Sep. 25, 2017

(87) PCT Pub. No.: WO2016/157077
PCT Pub. Date: Oct. 6, 2016

(65) Prior Publication Data

US 2018/0252503 A1 Sep. 6, 2018

(30) Foreign Application Priority Data

Mar. 30, 2015 (IN) ..... 879/DEL/2015

(51) Int. Cl.
*F41H 11/16* (2011.01)
*F41H 11/134* (2011.01)
*F41H 11/136* (2011.01)

(52) U.S. Cl.
CPC ..... *F41H 11/16* (2013.01); *F41H 11/134* (2013.01); *F41H 11/136* (2013.01)

(58) Field of Classification Search
CPC ..... F41H 11/16; F41H 11/134; F41H 11/136
(Continued)

(56) References Cited

U.S. PATENT DOCUMENTS 4,008,644 A * 2/1977 Kayser ..... F41H 11/16 89/1.13
5,712,441 A * 1/1998 Grunewald ..... F41H 11/16 86/50

(Continued)

OTHER PUBLICATIONS

International Preliminary Report on Patentability dated Oct. 3, 2017 in corresponding PCT/IB2016/051766, filed Mar. 29, 2016.

(Continued)

*Primary Examiner* — Michelle Clement
(74) *Attorney, Agent, or Firm* — Knobbe Martens Olson & Bear, LLP

(57) ABSTRACT

A vehicle for detecting and neutralizing an incendiary object comprises a detecting device configured to mount at fore-end of the vehicle is disclosed. The detecting device comprises: one or more platforms configured to be mounted at the fore end of the vehicle. The one or more platforms are located proximal to the ground surface such that they hover over the ground surface at a predetermined distance. A plurality of sensors wherein each of the plurality of sensors mounted on the at least one of the one or more platforms for capturing information related to the incendiary object. A neutralizing device interfaced with the detecting device, wherein the neutralizing device comprises: a neutralizing (Continued)

arm member which actuates in one or more directions for handling and neutralizing the incendiary object based on the information related to the incendiary object. An annihilator device equipped with the neutralizing device to annihilate the incendiary object.

14 Claims, 7 Drawing Sheets

(58) Field of Classification Search
USPC ..... 89/1.13
See application file for complete search history.

(56) References Cited

U.S. PATENT DOCUMENTS 5,856,629 A * 1/1999 Grosch ..... F41H 11/18 89/1.13
5,869,967 A * 2/1999 Straus ..... F41H 11/16 324/260
5,936,185 A * 8/1999 Tokuni ..... E02F 3/20 102/402
5,952,954 A * 9/1999 Beckner ..... G01S 7/2813 342/159
5,988,038 A * 11/1999 Feintuch ..... F41H 11/16 89/1.13
6,064,209 A * 5/2000 Banerjee ..... F41H 11/12 324/329
6,101,916 A * 8/2000 Panot ..... F41H 11/12 102/402
6,167,793 B1 * 1/2001 Nyfelt ..... F41H 11/12 89/1.13
6,341,551 B1 * 1/2002 Comeyne ..... F41H 11/134 86/50
6,343,534 B1 * 2/2002 Khanna ..... F41H 11/12 102/402
6,382,069 B1 * 5/2002 Haughom ..... F41H 11/26 89/1.13
6,393,959 B1 * 5/2002 Amemiya ..... E02F 3/3609 172/122
6,619,177 B1 * 9/2003 Hansen ..... F41H 11/18 89/1.13
6,626,078 B2 * 9/2003 Thornton ..... F41H 11/12 102/402
6,809,520 B1 * 10/2004 Nelson ..... G01V 3/15 324/239
6,876,308 B1 * 4/2005 Ghahramani ..... B60Q 7/00 102/402
7,082,743 B1 * 8/2006 Erickson ..... A01B 33/021 56/249
7,624,667 B2 12/2009 Kilkis
7,683,821 B1 * 3/2010 Clodfelter ..... F41H 11/12 342/22
7,717,023 B2 * 5/2010 Pereira ..... F42D 5/04 86/50
7,836,811 B1 * 11/2010 Gardner ..... F41A 23/28 102/402
7,987,760 B1 * 8/2011 Lundquist ..... F41H 11/12 86/50
8,240,238 B2 8/2012 Willner
8,240,239 B1 * 8/2012 Diaz ..... F41H 7/005 102/402
8,541,717 B2 * 9/2013 Hembise ..... F42D 5/04 219/482
8,677,876 B2 * 3/2014 Diaz ..... F41H 7/005 102/402
8,683,907 B1 * 4/2014 Howe ..... F41H 11/32 102/402
8,800,177 B2 * 8/2014 Harrington ..... F41H 11/16 37/344
9,488,450 B2 * 11/2016 Cunningham ..... B60P 1/5438
9,739,574 B1 * 8/2017 Vijay ..... F41H 11/18
10,145,660 B1 * 12/2018 Fluhler ..... F41H 11/136
10,393,489 B1 * 8/2019 Burmeister ..... C06C 5/04
2003/0136249 A1 * 7/2003 Inoue ..... F41H 11/12 89/1.13
2003/0196543 A1 * 10/2003 Moser ..... F41H 11/16 89/1.13
2004/0007122 A1 * 1/2004 Seregelyi ..... F41H 11/12 89/1.13
2004/0069133 A1 * 4/2004 Lowery ..... F41H 11/20 89/1.13
2004/0200341 A1 * 10/2004 Walters ..... F41H 11/12 89/1.13
2005/0128125 A1 * 6/2005 Li ..... F41H 11/12 342/22
2005/0230163 A1 * 10/2005 Cunningham ..... F41A 23/34 180/89.1
2005/0253711 A1 * 11/2005 Nelson ..... F41H 11/136 340/552
2005/0262995 A1 * 12/2005 Kilkis ..... F41H 11/12 89/1.13
2006/0037462 A1 * 2/2006 Marcolla ..... F41H 11/12 89/1.13
2006/0087471 A1 * 4/2006 Hintz ..... G01S 7/2923 342/22
2008/0092725 A1 * 4/2008 Simula ..... F41H 11/18 89/1.13
2008/0215185 A1 * 9/2008 Jacobsen ..... B64G 1/16 700/259
2009/0035097 A1 * 2/2009 Loane ..... B25J 5/007 414/4
2009/0223355 A1 * 9/2009 Manders ..... F41B 9/0031 89/1.13
2009/0302575 A1 * 12/2009 Archer ..... B60D 1/02 280/507
2010/0179691 A1 * 7/2010 Gal ..... F41H 7/005 700/259
2010/0270347 A1 * 10/2010 Kinzle ..... B60R 11/00 224/488
2010/0275472 A1 * 11/2010 Cunningham ..... B60P 1/5438 37/403
2011/0232468 A1 * 9/2011 Hembise ..... F41H 11/16 89/1.13
2012/0000350 A1 * 1/2012 Hubert-Habart ..... E01C 23/243 89/1.13
2012/0017707 A1 * 1/2012 Jackson ..... G01V 3/15 73/866.5
2012/0092019 A1 * 4/2012 Blum ..... G01V 3/088 324/457
2012/0185115 A1 * 7/2012 Dean ..... F41H 7/005 701/2
2012/0186422 A1 * 7/2012 Cuschieri ..... B63G 7/08 89/1.13
2013/0014633 A1 * 1/2013 Diaz ..... F41H 7/005 89/1.13
2013/0047701 A1 * 2/2013 Peltz ..... G01N 21/6402 73/23.2
2013/0090764 A1 * 4/2013 Summer ..... F41H 11/16 700/260
2013/0213116 A1 * 8/2013 Zengin ..... F41H 11/134 73/31.02
2013/0328713 A1 * 12/2013 Svane ..... F41H 7/02 342/70
2014/0062758 A1 * 3/2014 Mohamadi ..... F41H 11/136 342/53
2014/0125509 A1 * 5/2014 Stolarczyk ..... G01S 7/35 342/22
2014/0157975 A1 * 6/2014 Firth ..... F41H 11/30 89/1.13
2014/0266758 A1 * 9/2014 Gritz ..... H04W 8/005 340/686.6
2015/0032293 A1 * 1/2015 O'Neill ..... B25J 13/006 701/2
2015/0083901 A1 * 3/2015 Smith ..... G01N 21/27 250/226
2015/0301527 A1 * 10/2015 Erickson ..... B63H 21/21 701/2

(56) References Cited

U.S. PATENT DOCUMENTS

| | | | | |
|---|---|---|---|---|
| 2016/0018195 | A1* | 1/2016 | Bitar | F41H 11/30 89/1.13 |
| 2016/0245623 | A1* | 8/2016 | Nelson | G01V 3/17 |
| 2017/0153091 | A1* | 6/2017 | Diaz | F41H 11/13 |
| 2017/0192427 | A1* | 7/2017 | Bivans | G05B 19/0421 |
| 2019/0033441 | A1* | 1/2019 | Gonzles Valdes | G01S 7/40 |
| 2019/0301840 | A1* | 10/2019 | Olivier | G01V 11/00 |

OTHER PUBLICATIONS

International Search Report and Written Opinion dated Sep. 9, 2016, received in PCT/IB2016/051766, filed Mar. 29, 2016.

* cited by examiner

VEHICLE AND METHOD FOR DETECTING AND NEUTRALIZING AN INCENDIARY OBJECT

TECHNICAL FIELD

The present disclosure in general relates to a vehicle. Particularly but not exclusively to the vehicle and method of detecting and neutralizing an incendiary object located beneath a ground surface.

BACKGROUND OF THE DISCLOSURE

Humans and animals around the world are threatened by incendiary objects buried beneath the ground surface. The incendiary objects are potential threat to the humans and animals which can cause injury or even death due to stepping over the many different types of incendiary objects buried under the ground surface. These incendiary objects are buried beneath the ground surfaces which are invisible to the naked eye. Humans and animals who commute on foot in many such places where incendiary objects are buried, step on them and are prone to severe injuries such as loss of limbs and sometimes even loss of life. The incendiary objects are man-made objects which are buried at strategic locations for causing harm to the people, animals and disrupting peace amongst people.

In several scenarios, these incendiary objects are buried deep under the grounds which are virtually impossible to identify. Also, such deeply buried incendiary objects are threat to the vehicles which ply over them. When such a vehicle travels over this incendiary object, the vehicle is prone to heavy damages and even sometimes loss of life for the passengers seated within the vehicle.

In order to prevent injuries and death of the people and animals, numerous devices and techniques are developed to identify, locate and disarm such incendiary objects buried beneath the ground surface. Many deactivating techniques such as laser deactivation techniques, destruction of incendiary objects using the ammunitions etc. are already known in the art. However, detection, locating the incendiary object and finally disarming the same involves different equipment's and devices which need to be used. This combination of using different equipment's for disarming the incendiary object involves man power, and expensive devices. Also, there is a high risk involved for the people who are engaged in operating such devices during detection and disarming any of the incendiary objects.

The most common and standard technique of detecting, locating and disarming the incendiary object is by using the hand held incendiary object detector. This incendiary object detector is a hand held device which is operated by the user. The user plots the area to be scanned manually and uses this incendiary object detector to scan the ground surface for buried incendiary objects. This technique is known as incendiary object sweeping. The incendiary object detector generally senses for any metal objects buried under the ground. However, there is a risk involved in such sweeping exercise as the incendiary objects buried under the ground may not always be detected by the hand held incendiary object detector and the user many directly step on the incendiary object leading to catastrophic results.

Other techniques involve utilization of armoured vehicles which are provided with heavy armour for providing adequate safety to the occupants inside so that, when the armoured vehicle is driven over the incendiary object, the incendiary object blows up causing insignificant damage to the armoured vehicle. However, this technique cannot be used in all locations as some of the incendiary objects are buried beneath the ground surface which is unreachable to the vehicles. In many occasions, disarming an incendiary object involves training animals such as rats, mongoose etc. for smelling and detecting the incendiary object. However, this technique involves patience and the right trainers for training such animals in order to aid the humans in disarming the incendiary objects.

In light of the above, there is a need to develop a vehicle and method of detecting and neutralizing an incendiary object located beneath a ground surface such that, it is economical and avoids the above mentioned disadvantages.

SUMMARY OF THE DISCLOSURE

The shortcomings of the prior art are overcome and additional advantages are provided through the provision as claimed in the present disclosure. Additional features and advantages are realized through the techniques of the present disclosure. Other embodiments and aspects of the disclosure are described in detail herein and are considered a part of the claimed disclosure.

In an embodiment of the present disclosure, a vehicle for detecting and neutralizing an incendiary object located beneath a ground surface is disclosed. The vehicle comprises a detecting device configured to mount at fore-end of the vehicle, wherein the detecting device comprises: one or more platforms configured to be mounted at the fore end of the vehicle, wherein the one or more platforms are located proximal to the ground surface. A plurality of sensors, wherein each of the plurality of sensors mounted on the at least one of the one or more platforms for capturing information related to the incendiary object. A neutralizing device interfaced with the detecting device, wherein the neutralizing device comprises: a neutralizing arm member which actuates in one or more directions for handling and neutralizing the incendiary object based on the information related to the incendiary object. An annihilator device equipped with the neutralizing device to annihilate the incendiary object.

In an embodiment of the present disclosure, the one or more platforms comprises at least one of first platform and at least one of second platform which are configured with at least one first arm member and at least one second arm member respectively for extending and retracting the at least one first platform and the at least one second platform.

In an embodiment of the present disclosure, the at least one first arm member, the at least one second arm member and the at least one third arm member are configured to have multiple degrees of freedom and a defined proximal range of motion.

In an embodiment of the present disclosure, the at least one first arm member and the at least one second arm member are configured with scanners at tip ends of the arm members which hover and adjust the gap between the scanners and the ground surface when the vehicle is moving.

In an embodiment of the present disclosure, the neutralizing arm member is configured to have multiple degrees of freedom in at least one of X-axis, Y-axis, Z-axis along with pitch, roll and yaw movements for gripping and neutralizing the incendiary object.

In an embodiment of the present disclosure, the plurality of sensors is at least one of Ground penetrating radar, vapour detection sensor, obstacle detection sensor and thermal infrared mounted on the vehicle.

In an embodiment of the present disclosure, the ground penetrating radar and the vapour detection sensor are provided on the at least one first arm member.

In an embodiment of the present disclosure, the obstacle detection sensor is mounted on the at least one second arm member.

In an embodiment of the present disclosure, the Thermal Infrared is mounted on the top portion of the fore end of the vehicle.

In an embodiment of the present disclosure, the vehicle comprises a central processing unit being configured to receive data from the plurality of sensors mounted on the vehicle.

In an embodiment of the present disclosure, the annihilator device is at least one of water jet, laser beam clearance system, ammunition launcher, or shells launcher.

In an embodiment of the present disclosure, the vehicle comprises a marking tool located below the one or more platforms for marking the incendiary object after detection.

In an embodiment of the present disclosure, the vehicle comprises at least one image capturing device is mounted on the top portion of the vehicle for providing visual aid to the user.

In an embodiment of the present disclosure, the at least one image capturing device is at least one of video camera, infrared camera, night vision camera, high speed camera.

In an embodiment of the present disclosure, the vehicle comprises at least one multi-purpose tool kit mounted on either side of the fore end of the vehicle for performing excavation operations such as digging, shifting, gripping, hoisting and clearing the incendiary object.

In an embodiment of the present disclosure, a method of detecting an incendiary object located beneath a ground surface is disclosed. The method comprising steps of: sensing the incendiary object by a plurality of sensor mounted on one or more platforms of a vehicle. Reducing speed of the vehicle up on sensing the incendiary object, receiving command from at least one central processing unit configured in the vehicle, wherein a feedback signal is provided to the central processing unit for reducing the speed of the vehicle. Locating the incendiary object beneath the ground surface by the plurality of sensors mounted on the one or more platforms, wherein the feedback signal are provided to the central processing unit for stopping the vehicle up on determining position of the incendiary object. Receiving feedback signal from the plurality of sensors mounted on the one or more platforms, wherein the central processing unit processes the feedback signal and determines depth of the incendiary object beneath the ground surface. Operating at least one neutralizing arm member fixed at a central portion on the fore end of the vehicle, wherein the central processing unit generates operating signal for excavating and disarming the incendiary object provided, the incendiary object is at a predetermined depth. Annihilating the detected incendiary object by at least one annihilator device mounted on the top portion of the vehicle, wherein the central processing unit generates operating signal to the annihilator device provided, the incendiary object is at the predetermined depth.

In an embodiment of the present disclosure, the predetermined depth is at least one of shallow, deep.

In an embodiment of the present disclosure, the central processing unit on sensing depth of the incendiary object to be shallow, generates operational signal to the vehicle for stopping the motion of the vehicle.

In an embodiment of the present disclosure, the central processing unit on sensing depth of the incendiary object to be shallow, generates operational signal to the at least one neutralizing arm member for excavation by using at least one multi-purpose tool kit mounted on either side of the fore end of the vehicle.

In an embodiment of the present disclosure, the central processing unit on sensing depth of the incendiary object to be deep, generates operational signal to the vehicle for retracting the vehicle to a predetermined distance away from the identified incendiary object.

In an embodiment of the present disclosure, the central processing unit on sensing depth of the incendiary object to be deep retracts the vehicle to a predetermined distance away from the located incendiary object and generates operational signal to the annihilator device for neutralizing the incendiary object by using at least one of water jet, laser beam clearance system, ammunition launcher, shells launcher.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The novel features and characteristic of the disclosure are set forth in the appended claims. The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which:

Figure 8A:
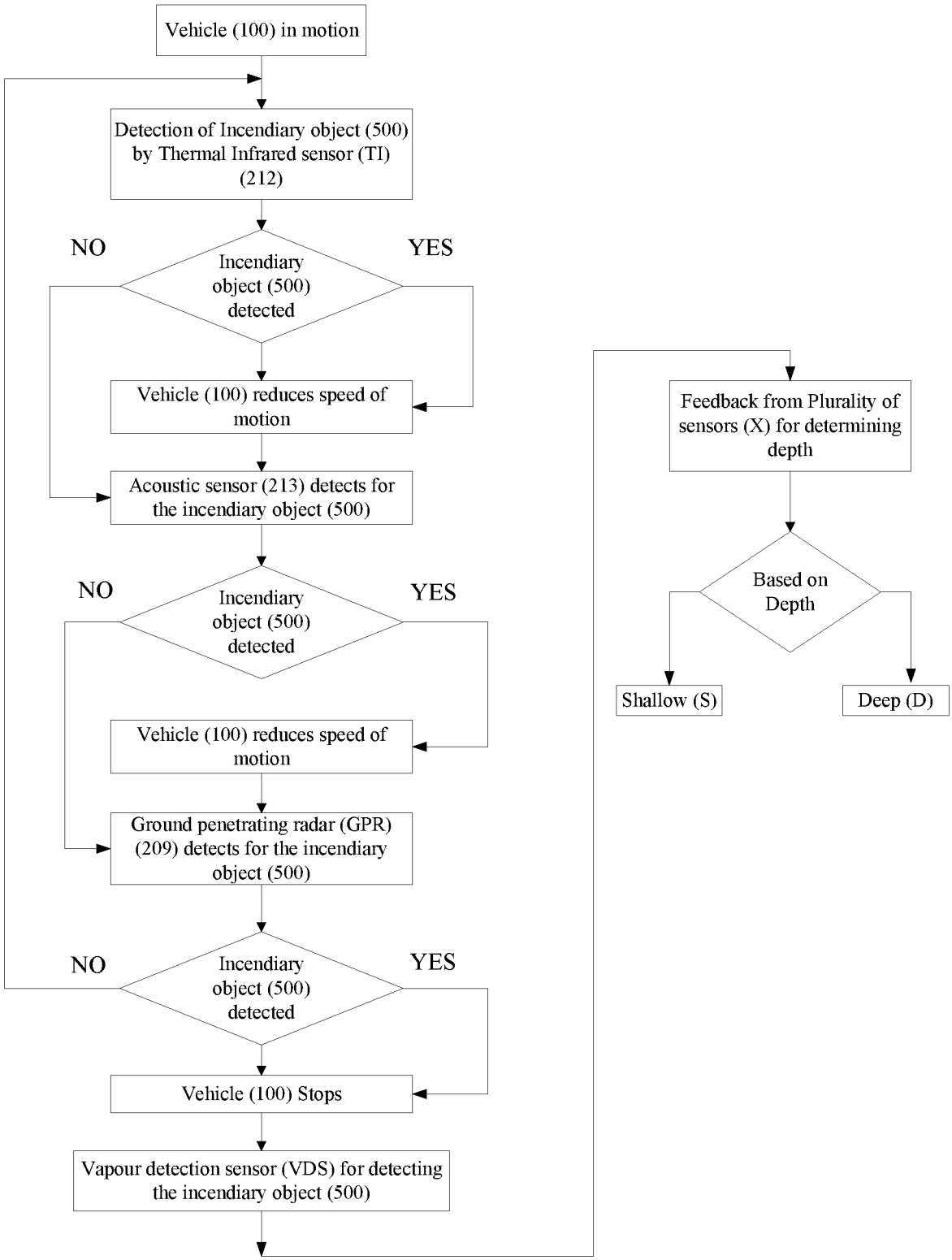
Figure 8B:
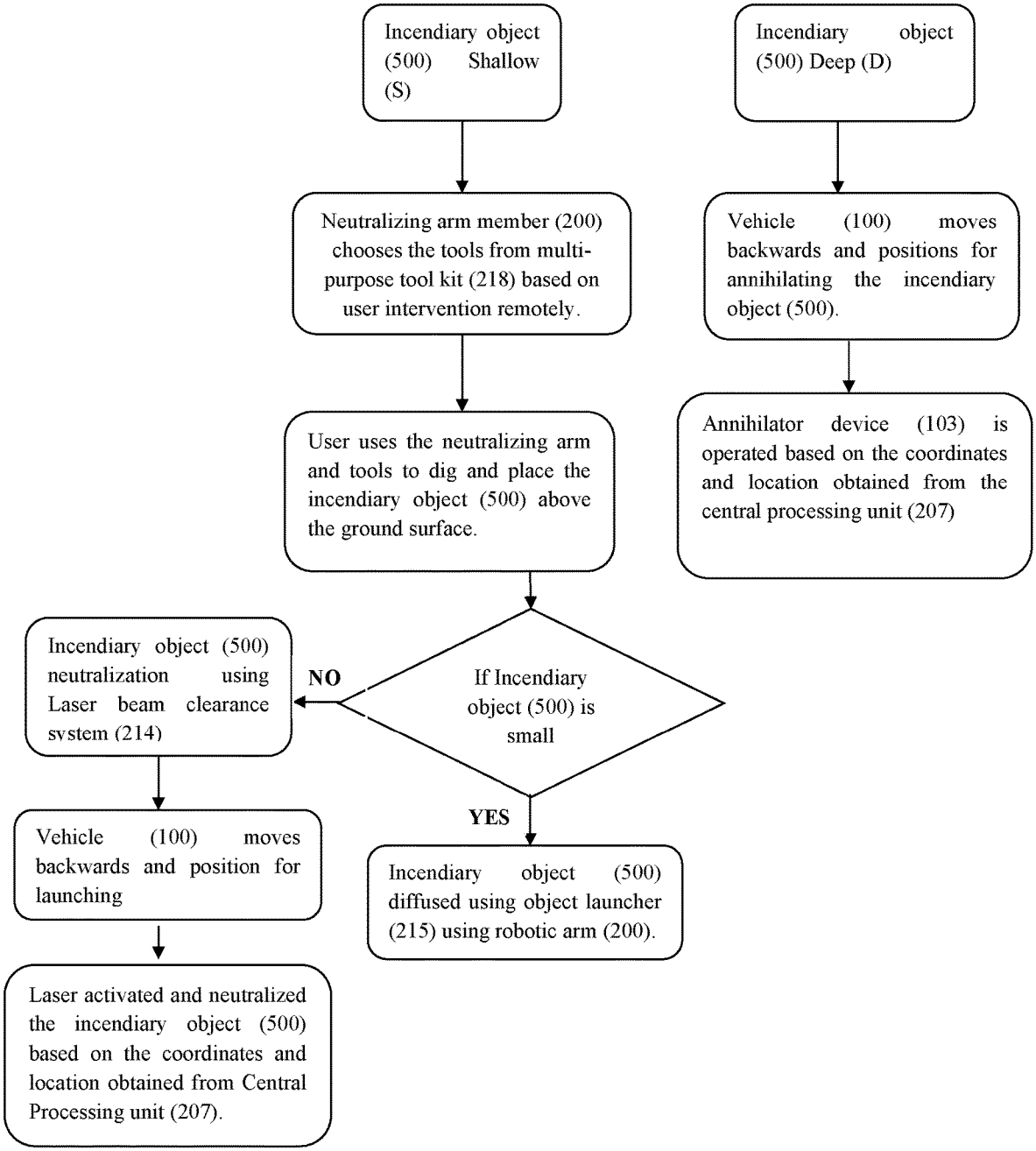

FIGS. 8*a* and 8*b* illustrates flow charts of the operation of the vehicle in detecting and neutralizing the incendiary object according to exemplary embodiments of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE DISCLOSURE

The foregoing has broadly outlined the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure. It will be readily understood that the aspects of the present disclosure, as generally described herein, and illustrated in the figures, can be arranged, substituted, combined, and designed in a wide variety of different configurations, all of which are explicitly contemplated and make part of this disclosure.

A vehicle for detecting and neutralizing an incendiary object located beneath a ground surface is disclosed. The vehicle comprises a detecting device configured to mount at fore-end of the vehicle, wherein the detecting device comprises: one or more platforms configured to be mounted at the fore end of the vehicle. The one or more platforms are located proximal to the ground surface such that they hover over the ground surface at a predetermined distance. A plurality of sensors wherein each of the plurality of sensors mounted on the at least one of the one or more platforms for capturing information related to the incendiary object. A neutralizing device interfaced with the detecting device, wherein the neutralizing device comprises: a neutralizing arm member which actuates in one or more directions for handling and neutralizing the incendiary object based on the information related to the incendiary object. An annihilator device equipped with the neutralizing device to annihilate the incendiary object.

Referring now to the drawings wherein the drawings are for the purpose of illustrating an exemplary embodiment of the disclosure only, and not for the purpose of limiting the same.

Figure 1:
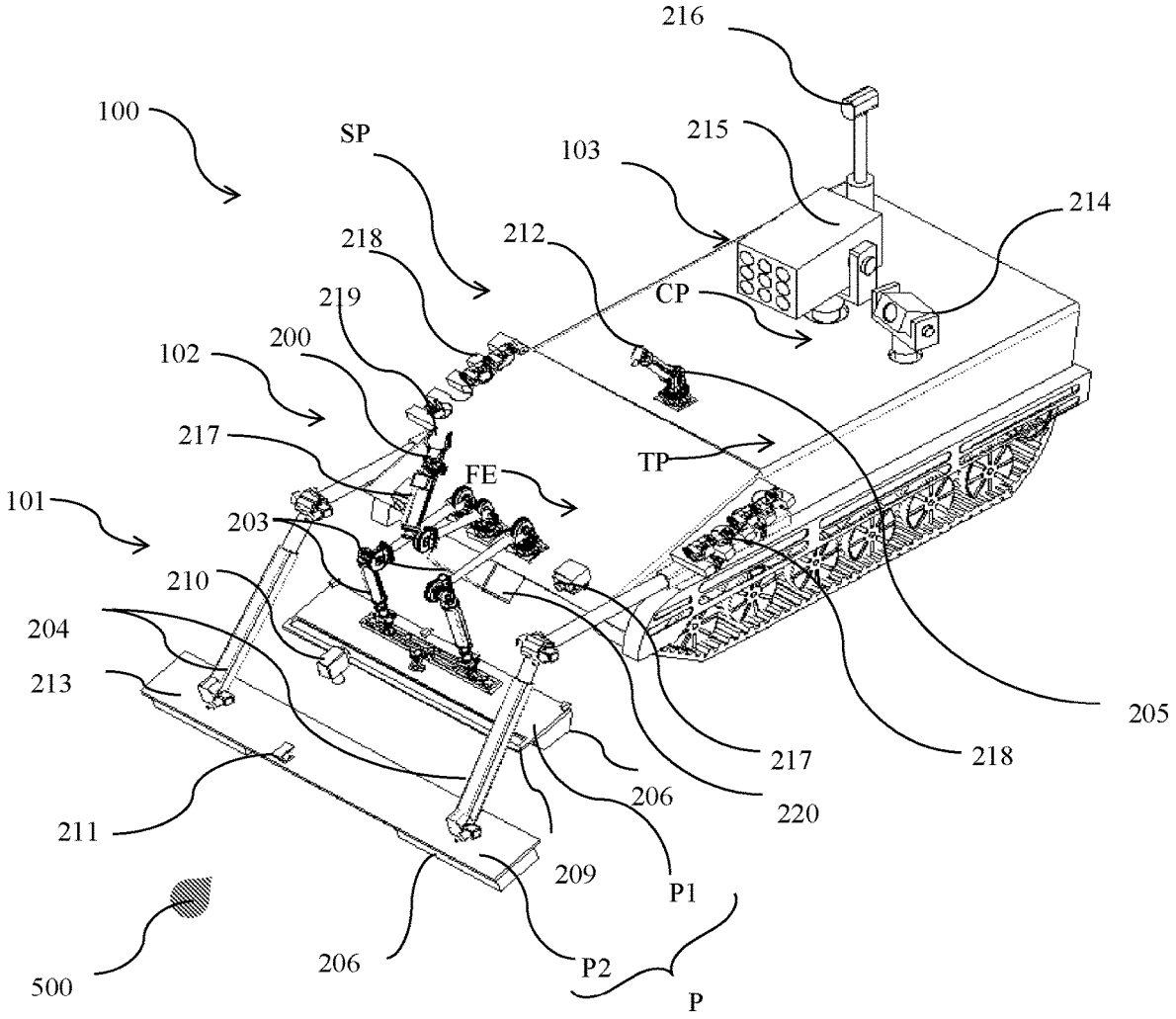
FIG. 1 illustrates perspective view of a vehicle for detecting and neutralizing an incendiary object according to an exemplary embodiment of the present disclosure.

FIG. 1 illustrates perspective view of a vehicle (100) for detecting and neutralizing an incendiary object (500) according to an exemplary embodiment of the present disclosure. The vehicle (100) is an unmanned armoured vehicle which is controlled by a user remotely. This unmanned armoured vehicle (100) herein referred to as vehicle (100) which is capable of absorbing the impact forces emanating from the incendiary object (500) buried below the ground surface. In an embodiment, the vehicle (100) consists of a fore end (FE), top portion (TP), central portion (CP) and side portion (SP) which houses the detecting and neutralizing devices. The fore end (FE) and tope portion (TP) of the vehicle (100) consists of a detecting device (101) consisting of one or more platforms (P). In an exemplary embodiment, the one or more platforms (P) consist of at least one first platform (P1) and at least one second platform (P2). The at least one first platform (P1) and the at least one second platform (P2) are provided such that, the tip ends of the at least one first platform (P1) and the at least one second platform (P2) are provided with scanners (206). In an embodiment, the scanners (206) hover above the ground surface such that, the scanners (206) aid in detection of the incendiary object (500). At least one first arm member (203) having its one end fixed to the fore end (FE) of the vehicle (100) and other end of the at least one first arm member (203) fixed to the at least one first platform (P1). In an embodiment, the at least one first arm member (203) extends and retracts the at least one first platform (P1) within the working range of the vehicle (100) as per the requirement of the user. At least one second arm member (204) having its one end fixed to the fore end (FE) of the vehicle (100) and other end of the at least one second arm member (204) is fixed to the at least one second platform (P2). In an embodiment, the at least one second arm member (204) extends and retracts the at least one second platform (P2) within the working range of the vehicle (100) as per the requirement of the user. The top portion (TP) of the vehicle (100) is provided with at least one third arm member (205) wherein one end of the at least one third arm member (205) is fixed to the top portion (TP) of the vehicle (100) and other end of the at least one third arm member (205) is provided with a plurality of sensors (X). The at least one first platform (P1) and the at least one second platform (P2)

The plurality of sensors (X) are provided on each of the at least one first platform (P1), the at least one second platform (P2) and the at least one third arm member (205). In an embodiment, the plurality of sensors (X) are at least one of ground penetrating radar (GPR) (209), vapour detection sensor (VDS) (210), obstacle detection sensor (ODS) (211), and thermal infrared sensor (TIS). In an embodiment, the ground penetrating radar (GPR) (209) and the vapour detection sensor (VDS) (210) arc provided on the at least one first platform (P1). The ground penetrating radar (GPR) (209) is provided on the front portion of the at least one first platform (P1). During operation, the at least one first arm member (203) extends and retracts the at least one first platform (P1) within the working area of the vehicle (100). The vapour detection sensor (VDS) (210) is provided at predetermined location on the at least one first platform (P1) for sensing and detecting the incendiary object (500) buried beneath the ground surface. In an embodiment, the obstacle detection sensor (ODS) (211) is provided on the at least one second platform (P2). During operation, the at least one second platform (P2) extends and retracts the at least one second platform (P2) within the working area of the vehicle (100). The obstacle detection sensor (ODS) (211) is provided at an exemplary location on the at least one second platform (P2) for sensing and detecting the incendiary object (500) buried beneath the ground surface. In an embodiment, the at least one first arm member (203) and the at least one second arm member (204) are configured to elevate up to a predetermined height once the incendiary object (500) has been detected. The at least one third arm member (205) is provided on top portion (TP) of the vehicle (100). The at least one third arm member (205) is provided such that, it towers over the one or more platforms (P). The thermal infrared sensor (TI) (212) is provided on the at least one third arm member (205) such that the thermal infrared sensor (TI) (212) is configured to scan the area in front of the vehicle (100) up to a predetermined distance.

A neutralizing device (102) is provided at fore end (FE) of the vehicle (100) such that, the neutralizing device (102) is provided at the central portion (CP) of the fore end (FE) of the vehicle (100). The neutralization device (102) comprises a neutralizing arm member (200) which operates in one or more directions. The neutralizing arm member (200) functions within proximal working range of the vehicle (100) in order to handle and neutralize the incendiary object (500). In an embodiment, the neutralizing arm member (200) is configured to have multiple degrees of freedom in at least one of X-axis, Y-axis, and Z-axis. In an embodiment, the neutralizing arm member (200) can configure itself to operate for handling an incendiary object (500) by pitching about an axis, by rolling about an axis and by yawing about an axis for neutralizing the incendiary object (500).

An annihilator device (103) comprises an object launcher (215) and a laser beam clearance system (214) which is provided on top portion (TP) of the vehicle (100). The annihilator device (103) is controlled by the user so as to annihilate the incendiary object (500). In an embodiment, the annihilator device (103) is at least one of object launcher (215), laser beam clearance system (214), water jet spray (not shown in figure) or any other device which serves the purpose of annihilating the incendiary object (500). The side portions (SP) of the vehicle (100) are equipped with a multi-purpose tool kit (218). The multi-purpose tool kit (218) is provided on either of the side portions (SP) which is within the reach of the neutralizing arm member (200). During the operation of neutralizing the incendiary object (500), the neutralizing arm member (200) reaches out to the multi-purpose tool kit (218) for specific tools for specific operations. In an embodiment, the neutralizing arm member (200) performs operations such as digging, shifting, gripping, hoisting and clearing the incendiary object. In an embodiment, the neutralizing arm member (200) is provided with a gripper (219) for gripping and handling the incendiary object (500).

A communication medium (216) is provided on top portion (TP) of the vehicle (100) for communicating with the user. The user remotely operates the vehicle (100) through a user interface for operating the vehicle (100). The signals are received wirelessly to a receiver provided within the vehicle (100) for operating the vehicle (100).

In an embodiment, the communication medium (216) is at least one of an antenna, a transmitter tower or any other medium which serves the purpose of transmitting and receiving data.

In an embodiment, the fore end (FE) of the vehicle (100) is provided with at least one image capturing device (217) which provides visual aid to the user. In an embodiment, the image capturing device (217) is at least one of infrared camera, night vision camera, heat sensing camera or any other camera which serves the purpose. In an embodiment, the image capturing device (217) is installed at specific locations to provide visual aid to the user in all angles.

In an embodiment, the vehicle (100) guides itself using at least one of an acoustic sensor (not shown in figure) which aids in determining the travel path of the vehicle (100). The acoustic sensor (ATS) (213) along with the image capturing device (217) aids the user to guide the vehicle (100) in the right path.

In an embodiment, the at least one second platform (P2) is provided with an obstacle detection sensor (ODS) (211) which aids in sensing obstacles within the path of the vehicle (100). In an embodiment, the obstacle detection sensor (ODS) (211) covers the entire dimension of the vehicle (100) avoiding any accidents or collisions with the surrounding obstacles.

Figure 2:
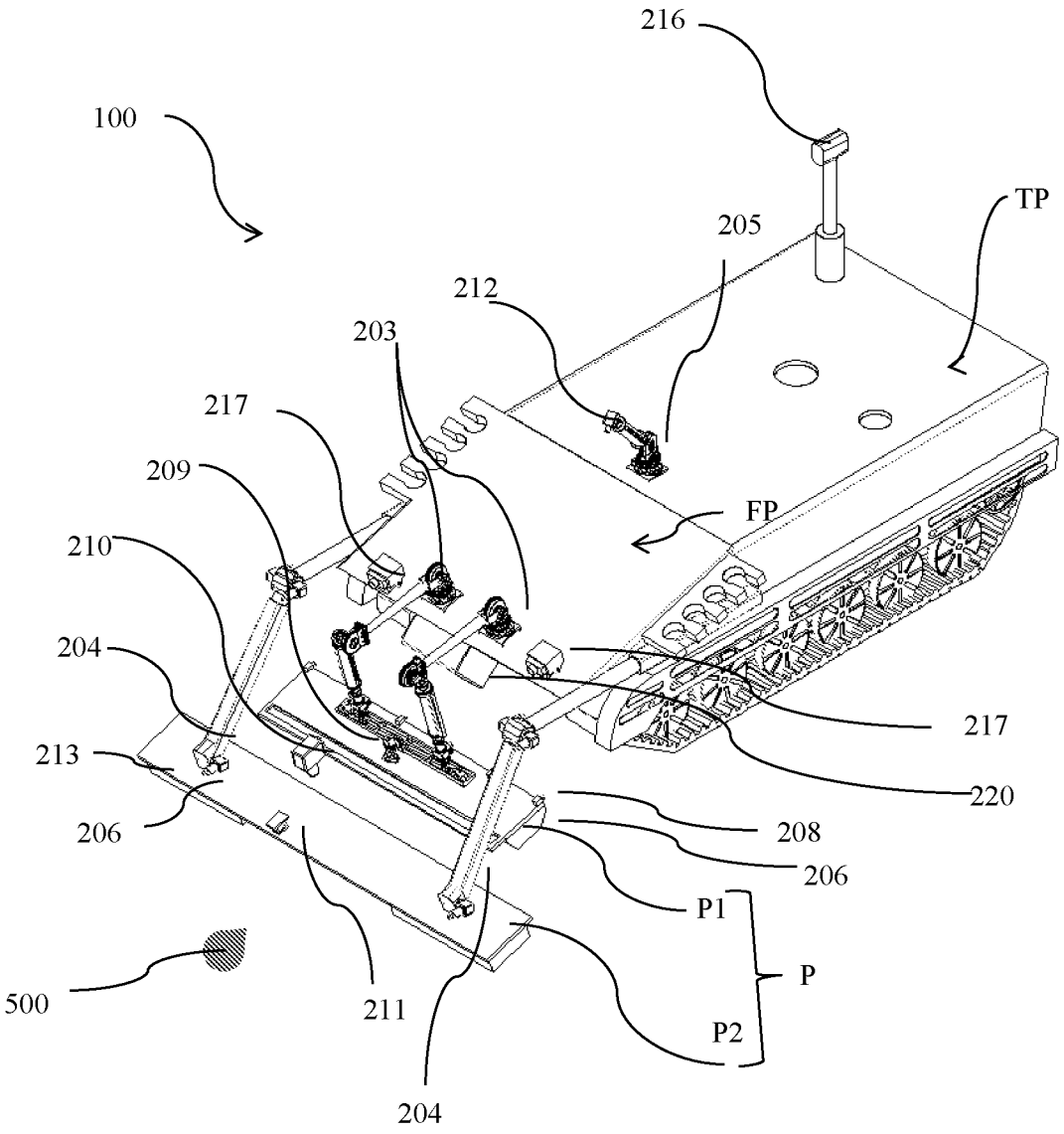
FIG. 2 illustrates perspective view of the vehicle with the detecting device and communications medium according to an exemplary embodiment of the present disclosure.

FIG. 2 illustrates perspective view of the vehicle (100) with the detecting device (101) and communications medium (216) according to an exemplary embodiment of the present disclosure. A central processing unit (CPU) (207) is provided within the vehicle (100) which receives and processes the signals for performing specific operations. The central processing unit (CPU) (207) controls various devices installed on the vehicle (100). During operation, the at least one third arm member (205) provided on top portion (TP) of the vehicle (100) towers over the at least one first arm member (203) and the at least one second arm member (204). The at least one third arm member (205) is equipped with at least one thermal infrared sensor (TI) (212) which scans the area provided in front of the fore end (FE) of the vehicle (100). In an embodiment, when the vehicle (100) is in motion, the thermal infrared sensor (TI) (212) detects the incendiary object (500) buried below the ground surface. The thermal infrared sensor (TI) (212) senses the incendiary object (500) and provides feedback signal to the user through the central processing unit (CPU) (207). The central processing unit (CPU) (207) processes this signal and reduces the speed of the vehicle (100). The ground penetrating radar (GPR) (209) provided on the at least one first platform (P1) scans and provides location co-ordinates of the incendiary object (500). Once the incendiary object (500) has been located, a marking tool (208) provided on the tip end of the at least one first platform (P1) marks the ground surface so as to provide visual indication to the user. In an embodiment, the marking tool (208) is at least one of hydraulic spray painting system, pneumatic spray painting system, flag marking system or any other marking system which serves the purpose. In an embodiment, the marking tool (208) also aids the user to define safe zones by spray painting the scanned locations of the vehicle (100) wherein the incendiary object (500) was not detected. The vapour detection sensor (VDS) (210) provided at predetermined location on the at least one first platform (P1) scans and senses the vapours present in the incendiary object (500). If the vapour detection sensor (VDS) (210) senses incendiary vapours, then a signal is generated and provided to the central processing unit (CPU) (207). The vehicle (100) is stopped and neutralizing operations are initiated.

Figure 3:
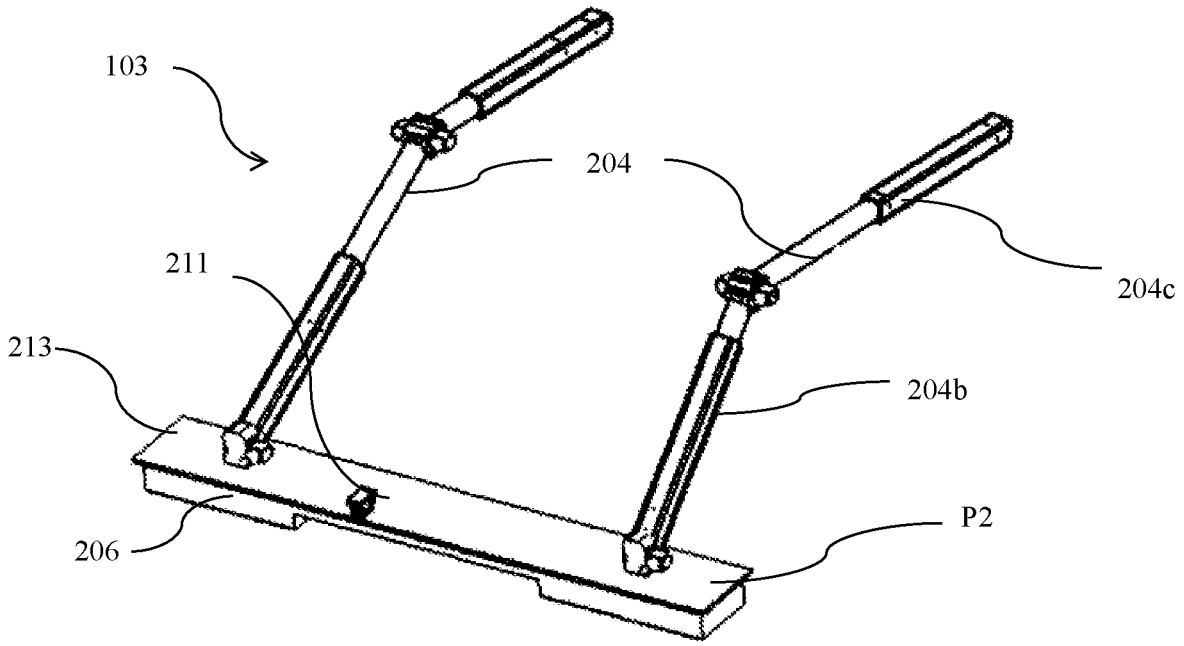
FIG. 3 illustrates perspective view of the first platform according to an exemplary embodiment of the present disclosure.
Figure 4:
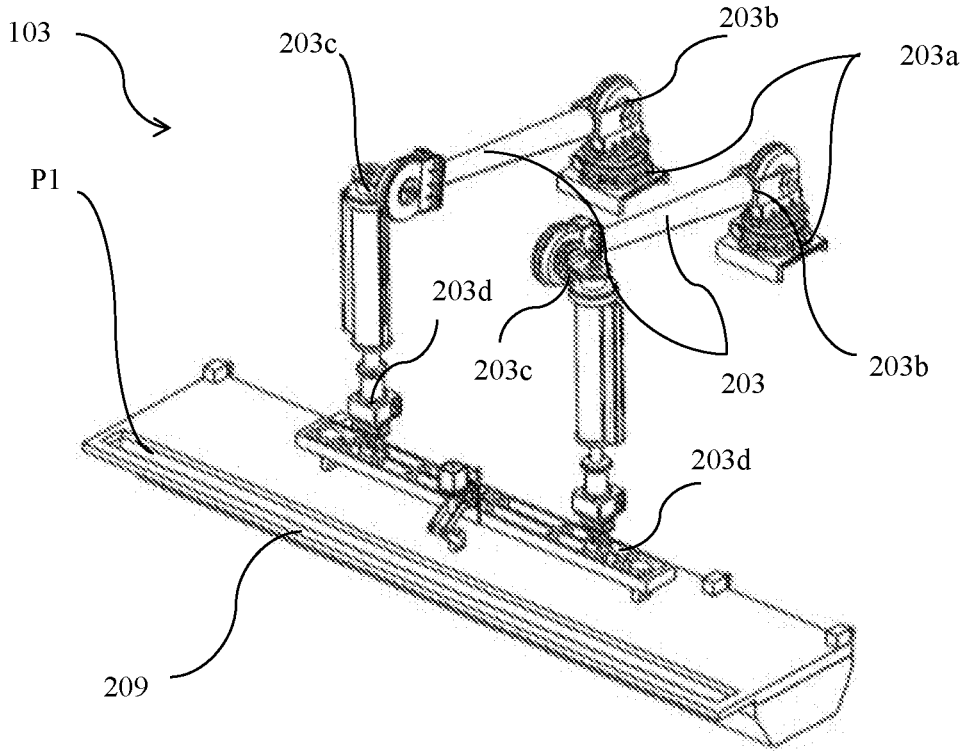
FIG. 4 illustrates perspective view of the second platform according to an exemplary embodiment of the present disclosure.
Figure 5:
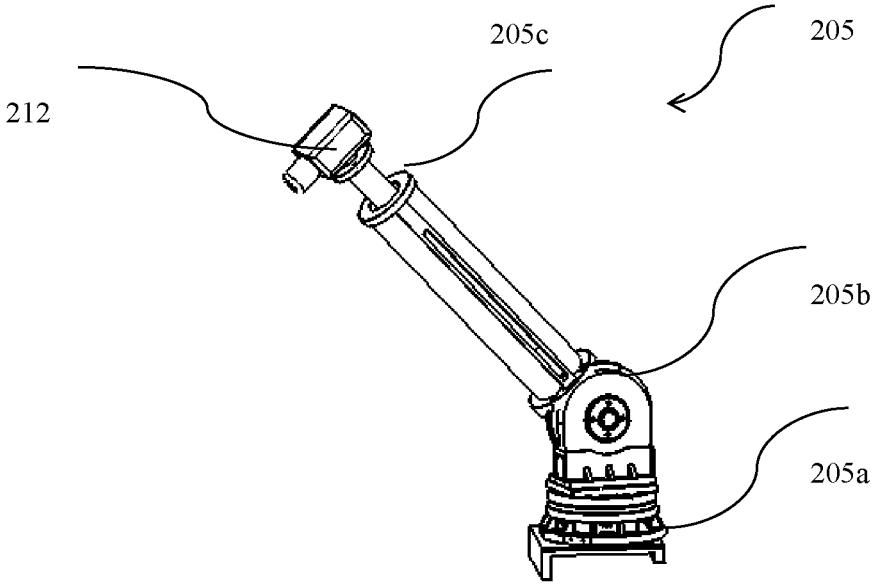
FIG. 5 illustrates front view of the third arm member according to an exemplary embodiment of the present disclosure.

FIGS. 3, 4 and 5 illustrates perspective views of the at least one first platform (P1), the at least one second platform (P2) and the at least one third arm member (205) according to an exemplary embodiment of the present disclosure. The at least one first platform (P1) is held by the at least one first arm member (203). In an embodiment, the at least one first platform (P1) is held together by dual first arm member (203). In an embodiment, the at least one first arm member (203) comprises of a base turret (203*a*), a back arm (203*b*), a fore arm (203*c*), a fore arm link (203*d*) and an end effectors (203*e*). In an embodiment, the at least one first arm member (203) is configured to have multiple degrees of freedom which is at least one of rotary-rotary-rotary-prismatic-rotary or any of these combinations. In an embodiment, the base turret (203*a*) has a rotary movement configuration, the back arm (203*b*) has a rotary movement configuration, the fore arm (203*c*) has a rotary movement configuration, the fore arm link (203*d*) has a prismatic or linear movement configuration and the end effectors (203*e*) has a rotary movement configuration.

The at least one second platform (P2) is held by the at least one second arm member (204). In an embodiment, the at least one second platform (P2) is held together by dual second arm member (204). The at least one second arm member (204) comprises of base turret (204*a*), back arm (204*b*) and a base link (204*c*). In an embodiment, the at least one second arm member (204) is configured to have multiple degrees of freedom which is at least one of prismatic-rotary-prismatic or any of these combinations. In an embodiment, the base turret (204*a*) has a prismatic or linear movement configuration, the back arm (204*b*) has a rotary movement configuration and the base link (204*c*) has a prismatic or linear movement configuration.

The at least one third arm member (205) comprises a base turret (205*a*), a base link (205*b*), and a back arm (205*c*). In an embodiment, the at least one third arm member (205) is configured to have multiple degrees of freedom which is at least one of rotary-prismatic-rotary or any of these combinations. In an embodiment, the base turret (205*a*) has a rotary movement configuration, the base link (205*b*) has a prismatic or linear movement configuration and the back arm (205*c*) has a rotary movement configuration.

Figure 6:
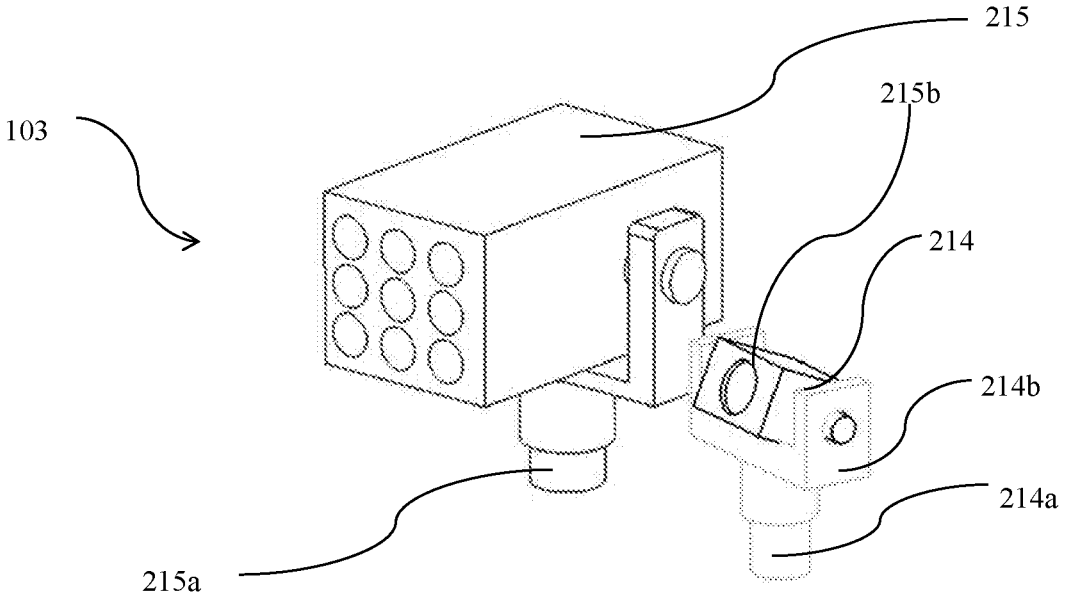
FIG. 6 illustrates perspective view of the annihilator device according to an exemplary embodiment of the present disclosure.

FIG. 6 illustrates perspective view of the annihilator device (103) according to an exemplary embodiment of the present disclosure. The annihilator device (103) is provided on top portion (TP) of the vehicle (100) wherein, the annihilator device (103) comprises of an object launcher (215) and a laser beam clearance system (214). The object launcher (215) and the laser beam clearance system (214) are provided on rotary turrets (214*a*, and 215*a*) and pivot means (214*b* and 215*b*). In an embodiment, the rotary turrets (214*a* and 215*a*) are configured to provide rotary movement configuration. In an embodiment, the pivot means (214*b* and 215*b*) are configured to provide pivoting/twisting movement configuration.

Figure 7:
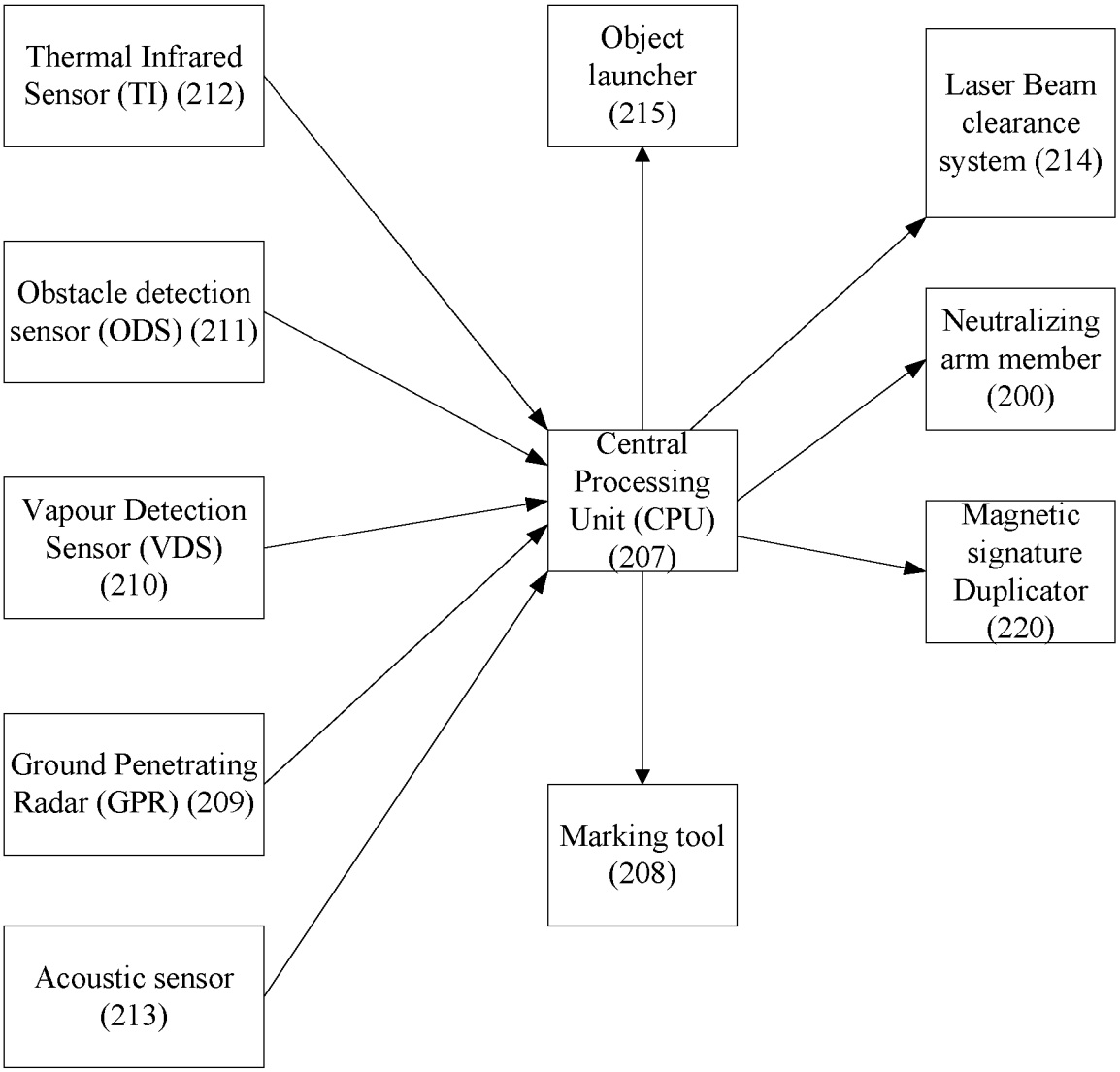
FIG. 7 illustrates block diagram of the operational sequence of the central processing unit according to an exemplary embodiment of the present disclosure.

FIG. 7 illustrates block diagram of the operational sequence of the central processing unit (CPU) (207) according to an exemplary embodiment of the present disclosure. During operation, the central processing unit (CPU) (207) receives various signals from the plurality of sensors (X) when the incendiary object (500) has been detected. When the vehicle (100) is in motion, the thermal infrared sensor (TT) (212) scans and detects for incendiary objects (500) buried beneath the ground surface. The obstacle detection sensor (ODS) (211) provides continuous feedback to the central processing unit (CPU) (207) which sends feedback signal to the user. The central processing unit (CPU) (207) then sends these signals to the user as a feedback signal. The ground penetrating radar (GPR) (209) and the vapour detection sensor (VDS) (210) scans within the proximal range of operation and sends continuous feedback signal to the central processing unit (CPU) (207). The acoustic sensor (ATS) (213) provided on the vehicle (100) senses or detects the presence of incendiary object (500) and provides feedback signal to the central processing unit (CPU) (207). The central processing unit (CPU) (207) receives feedback signals from the plurality of sensors (X) and based on the requirement, the central processing unit (CPU) (207) generates operational signals to the object launcher (215), the laser beam clearance system (214), the magnetic signature duplicator (220) and the neutralizing arm member (200).

In an embodiment, the user remotely operates the vehicle (100) which includes maneuvering the vehicle (100), operating the neutralizing arm member (200), detecting the incendiary object (500), operation of the magnetic signature duplicator (220) for disarming the incendiary object (500) through a user interface (not shown in figs). In an embodiment, the user interface is at least one of joystick, keyboard, operating console or any other device which serves the purpose.

In an embodiment, the magnetic signature duplicator (220) neutralizes the incendiary object (500) buried beneath the ground surface, such that a magnetic signature is generated to diffuse or detonate the incendiary object (500).

FIGS. 8*a* and 8*b* illustrates flow charts of the operation of the vehicle (100) in detecting and neutralizing the incendiary object (500) according to exemplary embodiments of the present disclosure. The user through the user interface operates motion of the vehicle (100). During operation, the vehicle (100) is in motion at a predetermined speed. The thermal infrared sensor (TI) (212) scans and senses the presence of the incendiary object (500) and provides feedback signal to the central processing unit (CPU) (207) which reduces speed of the vehicle (100). The acoustic sensor (ATS) (213) detects for the incendiary object (500) within its working radius, if the incendiary object (500) is identified, the acoustic sensor (ATS) (213) sends feedback signal to the central processing unit (CPU) (207) to further reduce speed of the vehicle (100). The ground penetrating radar (GPR) (209) after detection of the incendiary object (500) sends out locational co-ordinates to the user. The marking tool (208) is used to mark the location of the incendiary object (500). Simultaneously, the vapour detection sensor (VDS) (210) senses the various incendiary vapours and determines presence of the incendiary object (500). Once the vapour detection sensor (VDS) (210) determines the incendiary object (500) a feedback signal is provided to the central processing unit (CPU) (207) to stop the motion of the vehicle (100). The plurality of sensors (X) provides feedback signals to the central processing unit (CPU) (207) which determines depth of the incendiary object (500). In an embodiment, if the depth of the incendiary object (500) is shallow (S), then the central processing unit (CPU) (207) provides operational signal to the neutralizing arm member (200) for handling and neutralizing the incendiary object (500). In an embodiment, if the depth of the incendiary object (500) is deep (D), then the central processing unit (CPU) (207) provides operational signal to the annihilator device (103) for carrying out the annihilation of the incendiary object (500). In an embodiment, if the depth of the incendiary object (500) is shallow (S) then the neutralizing arm member (200) with the aid of the multi-purpose tool kit (218) performs operations such as digging, shovelling, drilling, gripping and neutralizing the incendiary object (500). In an embodiment, the multi-purpose tool kit (218) comprises of at least one of a digger tool, shovelling tool, excavation tool, gripping tool or any other tool which serves the purpose. In an embodiment, if the depth of the incendiary object (500) is deep (D) then the central processing unit (CPU) (207) retreats the vehicle (100) away from the location of the incendiary object (500) up to a safe distance. The central processing unit (CPU) (207) provides operational signal to the annihilator device (103) which annihilates the deeply buried incendiary object (500).

ADVANTAGES

In an embodiment, the detecting devices and the neutralizing devices are installed on the same vehicle leading to detection and neutralizing operations to be performed sequentially without using other vehicles.

In an embodiment, the annihilator device is provided within the vehicle for annihilating the incendiary object.

In an embodiment, the user operates the vehicle remotely and hence there is no risk involved in injury or loss of life.

In an embodiment, the marking tool aids visually identify the danger zone of the incendiary object.

In an embodiment, the obstacle detection sensor aids to protect the vehicle and sensors from dynamic obstacle in front of the vehicle.

In an embodiment, the arms can be utilised for multipurpose tasks such as handling incendiary object for loading and unloading requirements.

INDUSTRIAL APPLICABILITY

In an embodiment, the vehicle is used in detecting and neutralizing the incendiary object.

| REFERRAL NUMERALS | |
|---|---|
| 100 | Vehicle |
| 101 | Detecting device |
| 102 | Neutralizing device |
| 103 | Annihilator device |
| P | Platform |
| P1 | First platform |
| P2 | Second platform |
| X | Plurality of sensors |
| FE | Fore end |
| TP | Top portion |
| SP | Side portions |
| CP | Central portion |
| 200 | Neutralizing arm member |
| 203 | First arm member |
| 203a | Base turret |
| 203b | Back arm |
| 203c | Fore arm |
| 203d | Fore arm link |
| 203e | End effectors |
| 204 | Second arm member |
| 204a | Base turret |
| 204b | Back arm |
| 204c | Base link |
| 205 | Third arm member |
| 205a | Base turret |
| 205b | Base link |
| 205c | Back arm |
| 206 | Scanners |
| 207 | Central processing unit |
| 208 | Marking tool |
| 209 | Ground penetrating radar (GPR) |
| 210 | Vapour detection sensor (VDS) |
| 211 | Obstacle detection sensor (ODS) |
| 212 | Thermal infrared sensor (TI) |
| 213 | Acoustic sensor (ATS) |
| 214 | Laser beam clearance system |
| 214a | Rotary turret |
| 214b | Pivot means |
| 215 | Object launcher |
| 215a | Rotary turret |
| 215b | Pivot means |
| 216 | Communications medium |
| 217 | Image capturing device |
| 218 | Multi-purpose tool kit |
| 219 | Gripper |
| 220 | Magnetic signature duplicator |
| 500 | Incendiary object |

We claim:

1. A ground vehicle for detecting and neutralizing an incendiary object located beneath a ground surface, the vehicle comprising:

a detecting device configured to mount at a fore-end (FE) of the vehicle, wherein the detecting device comprises:

one or more platforms (P) configured to be mounted at the fore-end (FE) of the vehicle, wherein the one or more platforms (P) are located proximal to the ground surface;

a plurality of sensors (X) comprising a ground penetrating radar (GPR) sensor, an obstacle detection sensor (ODS), an acoustic sensor (ATS), and a thermal infrared sensor (TI), the ground penetrating radar (GPR) sensor, the obstacle detection sensor (ODS), and the acoustic sensor (ATS) being mounted on the one or more platforms (P) for capturing information related to the incendiary object; and a neutralizing device interfaced with the detecting device, wherein the neutralizing device comprises:

a neutralizing arm member configured to actuate in one or more directions for handling and neutralizing the incendiary object based on the information related to the incendiary object; and an annihilator device configured to annihilate the incendiary object, wherein the one or more platforms (P) comprise a first platform (P1) and a second platform (P2) which are configured with at least one first arm member and at least one second arm member, respectively, at least one of the ground penetrating radar (GPR) sensor, the obstacle detection sensor (ODS), or the acoustic sensor (ATS) being mounted on each of the first platform (P1) and the second platform (P2), wherein the at least one first arm member is configured to extend and retract the first platform (P1), and wherein the at least one second arm member is configured to extend and retract the second platform (P2); and at least one third arm member extending from a top portion (TP) of the vehicle and having a length that supports the thermal infrared sensor (TI) at a position above the at least one first arm member and the at least one second arm member so that the thermal infrared sensor (TI) can scan and detect the incendiary object before detection by the plurality of sensors (X) mounted on the first platform (P1) and the second platform (P2).

2. The vehicle as claimed in claim 1, wherein the at least one first arm member, the at least one second arm member, and the at least one third arm member are configured to have multiple degrees of freedom and a defined proximal range of motion.

3. The vehicle as claimed in claim 1, wherein the at least one first arm member and the at least one second arm member are configured with scanners at tip ends of the arm members which hover and adjust the gap between the scanners and the ground surface when the vehicle is moving.

4. The vehicle as claimed in claim 1, wherein the neutralizing arm member is configured to have multiple degrees of freedom in one of X-axis, Y-axis, and Z-axis for gripping and neutralizing the incendiary object.

5. The vehicle as claimed in claim 1, wherein the ground penetrating radar (GPR) is mounted on a front portion of the first platform (P1) of the one or more platforms (P) such that the front portion of the first platform (P1) and the ground penetrating radar (GPR) are proximal to the ground surface.

6. The vehicle as claimed in claim 1, wherein the obstacle detection sensor (ODS) and the acoustic sensor (ATS) are mounted on the second platform (P2) of the one or more platforms (P) such that the obstacle detection sensor (ODS) and the acoustic sensor (ATS) are proximal to the ground surface.

7. The vehicle as claimed in claim 1, further comprising a central processing unit (CPU) configured to receive data from the plurality of sensors (X).

8. The vehicle as claimed in claim 1, wherein the annihilator device is an ammunition launcher.

9. The vehicle as claimed in claim 1, further comprising a marking tool located below the one or more platforms (P) and configured to mark the incendiary object after detection.

10. The vehicle as claimed in claim 1, further comprising at least one image capturing device mounted on the top portion (TP) of the vehicle for providing visual aid to the user.

11. The vehicle as claimed in claim 10, wherein the at least one image capturing device is a video camera.

12. The vehicle as claimed in claim 1, further comprising at least one multi-purpose tool kit mounted on either side of the fore-end (FE) of the vehicle for performing excavation operations such as digging, shifting, gripping, hoisting, and clearing the incendiary object.

13. The vehicle as claimed in claim 1, is used in detecting and neutralizing the incendiary object.

14. The vehicle as claimed in claim 1, further comprising a magnetic signature duplicator positioned at the fore-end (FE) of the vehicle, wherein the magnetic signature duplicator is configured to generate a magnetic signature for diffusing or detonating the incendiary object buried beneath the ground surface.

* * * * *